US009868128B2

(12) United States Patent
Tepas et al.

(10) Patent No.: US 9,868,128 B2
(45) Date of Patent: Jan. 16, 2018

(54) FOAM DISPENSING ASSEMBLY

(71) Applicant: TWIST BEAUTY PACKAGING AIRSPRAY N.V., Alkmaar (NL)

(72) Inventors: Marcus Cornelis Jacobus Tepas, Callantsoog (NL); Shivan Ramdhiansing, Zoetermeer (NL)

(73) Assignee: Twist Beauty Packaging Airspray N.V., Alkmaar (NL)

( * ) Notice: Subject to any disclaimer, the term of this patent is extended or adjusted under 35 U.S.C. 154(b) by 317 days.

(21) Appl. No.: 14/411,186

(22) PCT Filed: Jun. 28, 2013

(86) PCT No.: PCT/NL2013/050470
§ 371 (c)(1),
(2) Date: Dec. 24, 2014

(87) PCT Pub. No.: WO2014/003567
PCT Pub. Date: Jan. 3, 2014

(65) Prior Publication Data

US 2015/0202645 A1 Jul. 23, 2015

(30) Foreign Application Priority Data

Jun. 29, 2012 (NL) ..... 2009084

(51) Int. Cl.
*B05B 11/00* (2006.01)
*B05B 7/00* (2006.01)

(52) U.S. Cl.
CPC ..... *B05B 11/3087* (2013.01); *B05B 7/0037* (2013.01); *B05B 11/3001* (2013.01)

(58) Field of Classification Search
CPC ..... B05B 7/0037; B05B 11/3087; B05B 11/3001
See application file for complete search history.

(56) References Cited

U.S. PATENT DOCUMENTS 8,292,127 B2 * 10/2012 van der Heijden ... B05B 7/0037 222/137
8,336,737 B2 * 12/2012 van der Heijden . B05B 11/0078 222/145.3

(Continued)

FOREIGN PATENT DOCUMENTS

FR 2867700 A1 9/2005

OTHER PUBLICATIONS

International Search Report dated Aug. 13, 2013 for PCT/NL2013/050470.

*Primary Examiner* — Frederick C Nicolas
*Assistant Examiner* — Bob Zadeh
(74) *Attorney, Agent, or Firm* — Banner & Witcoff, Ltd.

(57) ABSTRACT

A dispensing assembly to dispense a foam, having: a liquid pump having a liquid inlet (15) and a liquid outlet (16), an air pump having an air inlet (26) and an air outlet (27), a mixing chamber (29), wherein the air outlet and the liquid outlet are in fluid communication with the mixing chamber, a dispensing channel (30). A first end of the dispensing channel is in fluid communication with the mixing chamber (29) and the second end forms a dispensing opening (31) for dispensing of foam. The dispensing channel (30) and the mixing chamber (29) are connected to each other via a constriction. The constriction is formed by an opening having a cross section which decreases towards the dispensing channel.

20 Claims, 2 Drawing Sheets

(56) References Cited

U.S. PATENT DOCUMENTS

| | | | | |
|---|---|---|---|---|
| 2005/0205600 | A1 | 9/2005 | Ophardt et al. | |
| 2008/0169311 | A1* | 7/2008 | Van Der Heijden | B05B 11/3087 222/190 |
| 2008/0277426 | A1* | 11/2008 | van der Heijden | A47K 5/14 222/190 |
| 2010/0001024 | A1* | 1/2010 | van der Heijden | B05B 7/0025 222/190 |
| 2010/0015064 | A1* | 1/2010 | Rossel | A01N 25/16 424/45 |
| 2010/0089951 | A1 | 4/2010 | Yates | |
| 2010/0320232 | A1* | 12/2010 | van der Heijden | B05B 11/3087 222/190 |
| 2012/0074171 | A1 | 3/2012 | Quinlan | |
| 2014/0217624 | A1* | 8/2014 | Tepas | B05B 11/043 261/62 |
| 2015/0144661 | A1* | 5/2015 | Tepas | B05B 7/0037 222/190 |
| 2015/0202645 | A1* | 7/2015 | Tepas | B05B 7/0037 222/190 |

* cited by examiner

FOAM DISPENSING ASSEMBLY

CROSS-REFERENCE TO RELATED APPLICATIONS

The present application is a U.S. National Phase filing of International Application No. PCT/NL2013/050470, filed on Jun. 28, 2013, designating the United States of America and claiming priority to Netherlands Patent Application No. 2009084, filed Jun. 29, 2012, and this application claims priority to and the benefit of the above-identified applications, which are both incorporated by reference herein in their entireties.

BACKGROUND

The present invention relates to a foam dispensing assembly and a foam dispensing device comprising a foam dispensing assembly.

U.S. Pat. No. 5,443,569 discloses a foam dispensing device comprising a foam dispensing assembly. The foam dispensing assembly is configured to dispense a foam and comprises a double cylinder element mounted in an opening of a container comprising foam liquid. The cylinder element has a liquid cylinder and an air cylinder, wherein the liquid cylinder has a smaller diameter than the air cylinder. The liquid cylinder and the air cylinder are arranged substantially concentrically. The foam dispensing assembly further comprises a piston assembly comprising a liquid piston and an air piston for reciprocal movements in the liquid cylinder and air cylinder, respectively, and a common operating part for operating the liquid piston and air piston. A liquid pump chamber is at least partially defined by the liquid cylinder and the liquid piston, wherein the liquid pump chamber has a liquid inlet and a liquid outlet. An air pump chamber having an air inlet and an air outlet is at least partially defined by the air cylinder and the air piston. The piston assembly further comprises a dispensing channel in fluid communication with the liquid outlet and the air outlet, the dispensing channel ending in a dispensing opening.

SUMMARY

The aim of the invention is to provide a foam dispensing assembly configured to provide an improved foam quality or at least to provide an alternative dispensing assembly for a foam dispensing device.

The present invention provides dispensing assembly to dispense a foam, comprising:

a liquid pump having a liquid inlet and a liquid outlet, an air pump having an air inlet and an air outlet, a mixing chamber, wherein the air outlet and the liquid outlet are in fluid communication with the mixing chamber, a dispensing channel, wherein a first end of the dispensing channel is in fluid communication with the mixing chamber and the second end forms a dispensing opening for dispensing of foam, wherein the dispensing channel and the mixing chamber are connected to each other via a constriction, characterized in that the constriction is formed by an opening having a cross section which decreases towards the dispensing channel.

The mixing chamber is a chamber in which the air and liquid are mixed to form a mixture of air and liquid. The air outlet and the liquid outlet end in the mixing chamber, such that air pumped from the air pump and liquid pumped from the liquid pump chamber commingle in the mixing chamber.

In the foam dispensing assembly a constriction is provided between the mixing chamber and the dispensing channel which functions as an accelerator opening for acceleration of the mixture of liquid and air created in the mixing chamber. In the known dispensing assembly this constriction is formed in a wall between the mixing chamber and the dispensing assembly as a cylindrical opening with a constant diameter.

Decreasing the cross-section of the opening in the downstream direction, i.e. towards the dispensing opening, results in a more optimized flow of the mixture of air and liquid created in the mixing chamber. This optimized flow results in an improved foam quality having a better foam stability.

It is remarked that US 2012/0074171 A1, FR 2 867 700, and US 2010/0089951 disclose foam forming assemblies having a dispensing opening with a tapered or narrowing design. However, these designs do not show a constriction connecting the mixing chamber where air and liquid are mixed, with the dispensing passage.

In an embodiment, one or more foam forming devices are arranged in the dispensing passage, in particular one or more sieve elements. The one or more sieve elements may be any elements provided with a plurality of holes to improve the formation of homogeneous and/or fine foam bubbles, and for example comprise a mesh, sieve, net, sponge etc.

The constriction connecting the mixing chamber and the dispensing channel is configured to accelerate the flow of mixture of liquid and air formed in the mixing chamber towards the one or more foam forming devices in the dispensing passage. By providing the constriction to accelerate the flow of mixture of liquid and air formed in the mixing chamber towards the one or more foam forming devices makes the flow more effectively impinge on the one or more foam forming devices, to improve the formation of homogeneous and/or fine foam bubbles in the dispensing passage. To improve formation of foam, the constriction and the one or more foam-forming devices in the dispensing passage may be spaced with respect to each other. The distance between the constriction and the first of the one or more foam forming devices, for example a first sieve element, is preferably selected to have the accelerated flow of the mixture of air and liquid created in the mixing chamber and accelerated by the constriction to effectively impinge on the first of the one or more foam forming devices to improve foam formation. This distance is for example between 1.8 mm and 2.5 mm, preferably between 2 mm and 2.3 mm. The first foam forming device or first sieve element is the element closest to the constriction in the flow path of the mixture of liquid and air.

In an alternative embodiment, one of the one or more foam forming devices, for example a sieve element may be arranged directly adjacent to the constriction.

In an embodiment, the cross-section of the constriction is smaller than the cross-section of the mixing chamber and the cross-section of the dispensing channel adjacent to the constriction.

The smallest cross-section of the constriction, when formed as a circular cross-section is preferably between 1 mm and 3 mm, preferably about 2 mm in diameter. Correspondingly, the surface area of the smallest cross-section of the constriction is preferably between about 0.78 $mm^2$ and about 7.07 $mm^2$, preferably about 3.14 $mm^2$.

In an embodiment, the opening tapers towards the dispensing channel. In such embodiment the cross-section of the opening at least partially gradually decreases in direction of the dispensing channel. The opening may for instance have a conical part which narrows towards the dispensing channel.

In an embodiment, the wall forming the opening comprises a circumferential rim between the mixing chamber and the dispensing channel. The provision of a circumferential rim, for example an annular rim, in the opening may cause turbulence in the flow of the mixture of gas and liquid in the opening. This turbulence improves mixing of gas and liquid, and therewith the foam quality of the foam produced by the dispensing device. The rim may for example be formed by the transition from a first surface to a second surface, such as the transition of a conical surface to a cylindrical surface, or by a rib or ridge formed on the internal surface of the opening.

A preferred embodiment of the constriction comprises a first cylindrical part having a first diameter and a second cylindrical part having a second diameter, wherein the first cylindrical part is closer to the mixing chamber than the second cylindrical part and wherein the first diameter is larger than the second diameter, wherein more preferably the first cylindrical part and the second cylindrical part are connected to each other by a conical part.

In an embodiment, a height of the mixing chamber is in the range 2.5 mm and 3.5 mm, preferably between about 2.8 mm and about 3.3 mm. This is a reduced height with respect to the conventional dispensing assembly. This reduced height improves the flow-through of the mixture of liquid and air towards the dispensing opening which is important for the formation of foam.

In an embodiment, the mixing chamber has a cylindrical interior having an internal diameter, wherein the internal diameter of the mixing chamber adjacent the constriction is substantially smaller than the internal diameter of the dispensing channel adjacent the constriction. The internal diameter of the mixing chamber is substantially larger than the diameter of the constriction between the mixing chamber and the dispensing channel, for example at least twice the diameter of the smallest cross section of the constriction opening.

In an embodiment, the internal diameter of the mixing chamber is at least 1.5 times, preferably two times the height of the mixing chamber between the constriction and the liquid outlet. In such embodiment, the interior of the mixing chamber has the shape of a relative wide and low cylinder. It is remarked that radial partition walls may be arranged in the mixing chamber, extending from the cylindrical inner wall to improve the mixing of air and liquid in the mixing chamber.

In an embodiment, an effective pump volume of the air pump chamber is maximally 8 times an effective pump volume of the liquid pump chamber. Conventional foam dispensing assemblies use typically an air to liquid ratio of 10:1. In hand-held devices which are operated and held by a single hand, the maximum stroke of the foam dispensing assembly is limited by the reach of the finger, typically the index finger. As a result, the diameter of the air cylinder is relative large which results in much plastics material to be used for the large diameter cylinder.

By reducing the air to liquid ratio to maximally 8:1, for example about 7:1, the maximum diameter of the air cylinder of the air pump can be reduced which results in a reduction of material to be used for the foam-dispensing assembly, and therefor in a reduction of costs. However, a smaller amount of air generally also results in lower foam quality, in particular a wetter foam. Since some further features of the present invention improve foam quality, the air to liquid ratio of a foam dispensing assembly may be reduced while at the same time an acceptable foam quality is maintained.

The effective pump volume is the surface area of the respective piston times the stroke of this piston in a full actuation stroke.

In an embodiment, the dispensing assembly comprises a sieve carrier device having an internal channel which at least partly forms the dispensing channel, wherein the sieve carrier device supports a first sieve element and a second sieve element, wherein the first sieve element and the second sieve element extend across a cross section of the internal channel in a spaced relationship, and wherein a cross section of the internal channel between the first sieve element and the second sieve element increases in a downstream direction.

The conventional foam dispensing assembly comprises a tube shaped sieve carrier device having an internal channel with a constant diameter between the first sieve element and the second sieve element. Increasing the cross section between the first sieve element and the second sieve element has a positive effect on the foam quality of the foam created by the foam dispensing assembly. Increasing the cross section may be gradually over at least a part of the length of the internal channel, but may also be stepwise.

It is remarked that a sieve carrier device having an internal channel which increases in cross section in downstream direction may also be applied in embodiments of dispensing assemblies, in which a constriction between the mixing chamber and the dispensing passage with a constant cross section is provided.

The first sieve element and the second sieve element may be any element provided with a plurality of holes to improve the formation of homogeneous and/or fine foam bubbles, and for example comprise a mesh, sieve, net, sponge etc.

In an embodiment, the sieve carrier device comprises a first tube-shaped part forming a first internal channel part of the internal channel and having a first internal channel diameter and an adjoining second tube-shaped part forming a second internal channel part of the internal channel and having a second internal channel diameter, wherein the first tube-shaped part supports the first sieve element and the second tube-shaped part supports the second sieve element and wherein the first internal channel diameter is larger than the second internal channel diameter.

In an embodiment, an end of the first tube-shaped part facing away of the second tube-shaped part supports the first sieve element and wherein an end of the second tube-shaped part facing away of the first tube-shaped part supports the second sieve element.

In an embodiment, a transition between the first internal channel part and the second internal channel part forms an annular rim, and wherein the sieve carrier device comprises a third sieve element extending across the cross section of the internal channel and wherein the third net element is supported by the annular rim.

The invention further relates to a container containing a foamable liquid and having an opening, and the dispensing assembly according to the invention mounted on or in the opening of the container.

BRIEF DESCRIPTION OF THE DRAWINGS

An embodiment of a foam dispensing assembly and foam dispensing device according to the invention will now be described in further detail, by way of example only, with reference to the accompanying drawings, in which.

DETAILED DESCRIPTION

Figure 1:
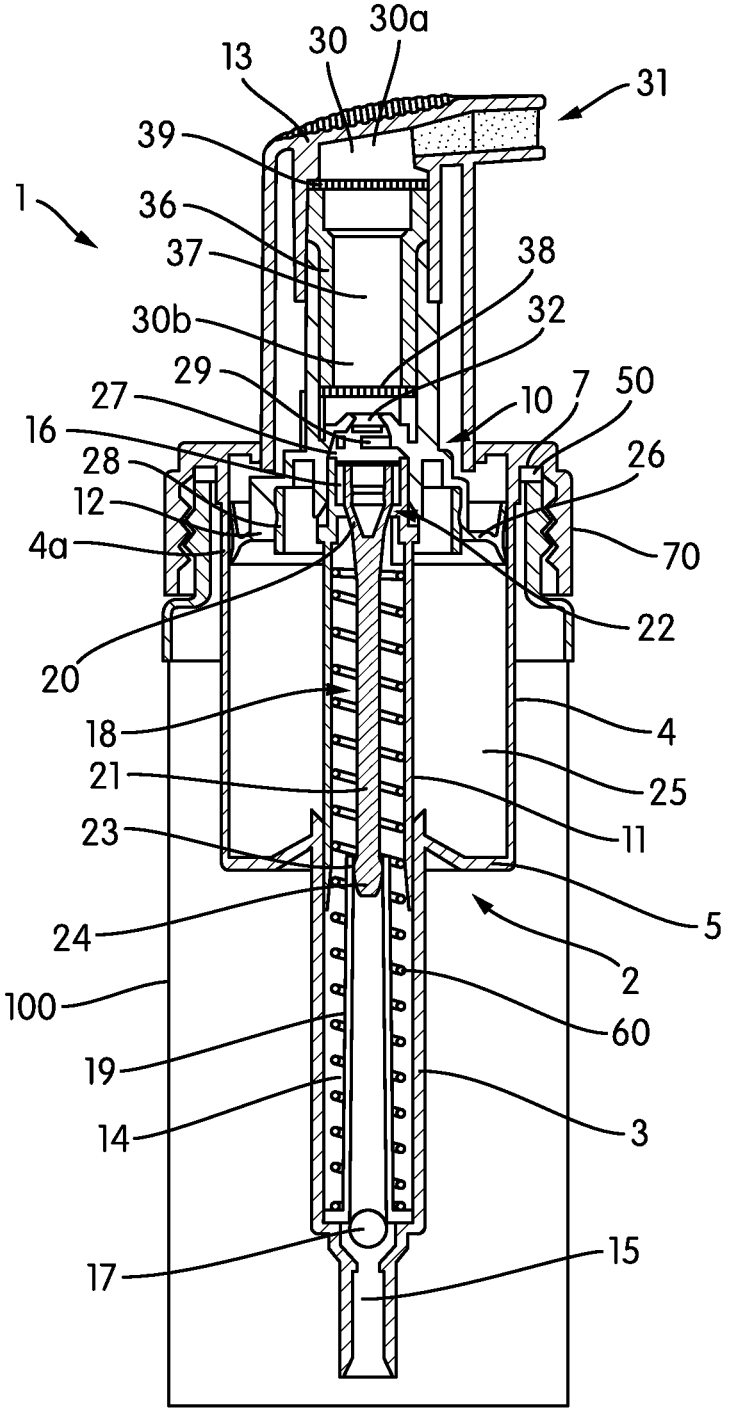
FIG. 1 shows a cross section of a foam dispensing assembly according to the invention.

FIG. 1 shows an embodiment of a foam dispensing assembly according to the invention, generally indicated by reference numeral 1. The foam dispensing assembly 1 comprises a double cylinder element 2, having a liquid cylinder 3 and an air cylinder 4. A top end of the liquid cylinder 3 is connected to a bottom end of the air cylinder 4 by a connecting wall 5. The diameter of the air cylinder 4 is substantially larger than the diameter of the liquid cylinder 3.

The liquid cylinder 3 and the air cylinder 4 are arranged substantially concentrically with respect to each other.

The air cylinder 4 comprises an opening 4*a* through which air may be introduced into the container 100 to replace liquid pumped out of the container 100.

The double cylinder element 2 is arranged in an opening of a container 100. The double cylinder element 2 comprises at the top end of the air cylinder a flange 7 with which the double cylinder element 2 is mounted with a screw collar 70 on a screw thread arranged on the container 100. A sealing ring 50 is arranged between the flange 7 and the screw collar 70 to improve the sealing of the interior of the container 100.

The dispensing assembly 1 may also be mounted in any other suitable way on the container 1, for example a click-fit or bayonet connection.

The dispensing assembly 1 further comprises a piston assembly 10 comprising a liquid piston 11 and an air piston 12 for reciprocal movements in the liquid cylinder 3 and the air cylinder 4, respectively, and a common operating part 13 for operating the liquid piston 11 and the air piston 12.

A liquid pump chamber 14 is formed by the space delimited by the liquid piston 11 and the liquid cylinder 3. The liquid pump chamber 14 comprises a liquid inlet 15 and a liquid outlet 16. A ball valve 17 is arranged in the liquid inlet 15 as a one-way valve to avoid that liquid is pumped back into the container 100.

In the liquid pump chamber 14, a valve assembly is arranged as a one way valve for the liquid outlet 16.

The valve assembly comprises an elongate valve element 18 and an elongate stem element 19 which are movable with respect to each other in axial direction. The valve element 18 comprises a valve head 20 and an extension part 21 ending in a bulge 24. The valve head 20 is movable between a closed position, wherein the valve head 20 is in sealing engagement with a valve seating 22 formed in the liquid outlet 16, and an open position, wherein the valve head is at least partially spaced from the valve seating 22.

The bulge 24 of the extension part 21 extends through an opening 23 into the stem element 19, which is configured such that the bulge 24 with normal force cannot be pulled out of the opening 23.

A spring 60 is provided to bias the valve element 18 and the stem element 19 away from each other. When no external force is exerted on the piston assembly 10, the spring 60 will push the valve element 18 and the stem element 19 away from each other, until further movement is blocked by the bulge 24 in the opening 23, as shown in FIG. 1. As a result, the valve seating 22 will be pressed in sealing engagement against the valve head 20, the valve head 20 being in the closed position.

When the liquid piston 11 is moved downwards, the valve head 20 will not be pulled on the valve seating 22, and the valve head 20 may move to the open position so that liquid can flow through the liquid outlet 16.

This construction provides a reliable closure of the liquid outlet 16 in the rest position of the foam dispensing assembly 1, while the valve head 20 is reliably movable to the open position when the piston assembly 10 is actuated. Any other suitable valve construction may also be applied.

An air pump chamber 25 is delimited by the air piston 12, the air cylinder 4, the connecting wall 5 and an outer surface of the liquid piston 11. The air pump chamber 25 comprises an air inlet 26 and an air outlet 27. The air inlet 26 provides an air connection between the air pump chamber 25 and the environment.

The air inlet 26 is formed by a number of through-going holes in the air piston 12. A valve device 28 for both the air inlet 26 and the air outlet 27 is provided to control the air flows in and out of the air pump chamber 25. The valve device 28 is a double lip valve device having a cylindrical base part supporting an outer lip as air inlet valve and an inner lip as air outlet valve. Such double lip valve device for the air inlet and air outlet is described in more detail in U.S. Pat. No. 5,443,569.

Any other valve device for the air inlet and/or air outlet may also be applied. This may be a combined valve device for the air inlet and the air outlet or a separate valve device for the air inlet and a separate valve device for the air outlet. It may also be possible that the air outlet does not comprise a valve device.

The liquid outlet 16 and the air outlet 27 join in a mixing chamber 29. Liquid coming from the liquid outlet 16 enters in a substantially vertical direction the mixing chamber as an annular flow about the circumference of the valve head 20. Air coming out the air outlet 27 enters in a substantially horizontal inwards direction in an annular flow from channels formed between the liquid piston 11 and the air piston 12.

The mixing chamber 29 is configured for mixing liquid coming from the liquid outlet 16 and air from the air outlet 27 to form a mixture of liquid and air. This mixture is guided through a dispensing channel 30 to a dispensing opening 31 where the mixture may be dispensed. Between the mixing chamber 29 and the dispensing channel a constriction is provided formed by an opening 32. The constriction acts as an accelerator for the mixture of liquid and air formed in the mixing chamber 29.

Figure 2:
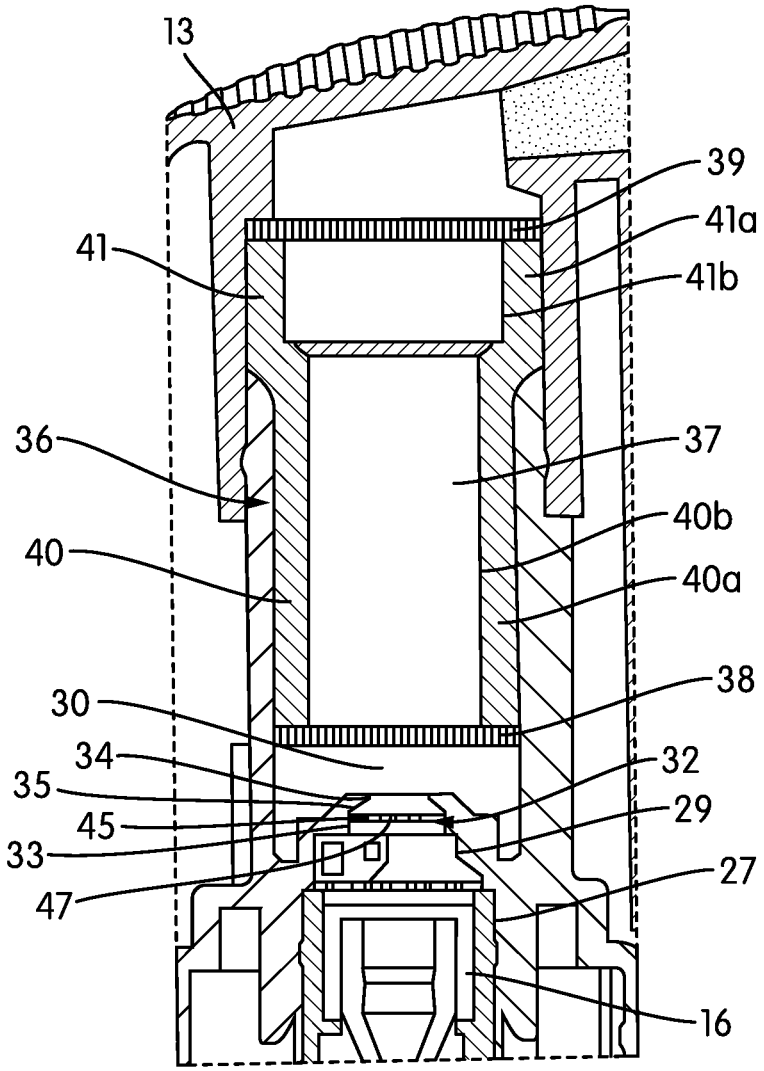
FIG. 2 shows a detail of FIG. 1.

FIG. 2 shows the mixing chamber 29 and a substantial part of the dispensing channel 30 in more detail.

The opening 32 comprises a cross section which decreases towards the dispensing channel 31.

The opening 32 comprises a first cylindrical part 33 having a first diameter and a second cylindrical part 34 having a second diameter, wherein the first cylindrical part 33 is closer to the mixing chamber 29 than the second cylindrical part 34 and wherein the first diameter is larger than the second diameter. The first cylindrical part 33 and the second cylindrical part 34 are connected to each other by a conical part 35. As a result of this arrangement, the opening 32 tapers towards the dispensing channel 30.

The decreasing cross-section of the opening towards the dispensing channel 30 has an improving effect on foam quality, in particular foam stability of the foam formed by the foam dispensing assembly.

The transitions between the first cylindrical part 33 and the conical part 35 and between the conical part 35 and the second cylindrical part 34 each form an annular rim 45. Such annular rim may promote turbulence in the flow of mixture of liquid and air from the mixing chamber 29 to the dispensing channel 30. This turbulence may also improve foam quality formed by the dispensing assembly 1. A third sieve element 47 may extend across the cross section of the internal channel and wherein the third sieve element 47 is supported by the annular rim 45.

The mixing chamber 29 comprises a substantially cylindrical interior having a relatively low height of for example between about 2.5 mm and about 3.5 mm. Further, the internal diameter of the mixing chamber 29 is preferably at least 1.5 times the height of the mixing chamber 29. The internal diameter of the mixing chamber 29 adjacent to the opening 32 is substantially smaller than the internal diameter of the dispensing channel 30 adjacent to the opening 32.

Downstream of the opening 32, a sieve carrier device 36 is mounted in the dispensing channel 30. The sieve carrier device 36 comprises an internal channel 37 which at least partly forms the dispensing channel 30. In the shown embodiment, the sieve carrier device 36 is a separate part, but it also may be integrated in another part forming the dispensing channel 30.

At a first end, the sieve carrier device 36 supports a first sieve element 38 and at the opposed end a second sieve element 39. The first sieve element 38 and the second sieve element 39 extend across the cross section of the internal channel 37 in a spaced relationship. The first sieve element 38 and the second sieve element 39 may comprise a sieve or mesh or other element having fine holes which improve the formation and homogenization of foam. When the foam is pressed through the holes, this will result in more homogeneous and fine foam bubbles.

The first sieve element 38 is arranged in a spaced relationship with the opening 32 to receive an accelerated flow of mixture of air and liquid formed in the mixing chamber 29. The distance is selected such that the accelerated flow of the mixture of liquid and air formed in the mixing chamber 29 effectively impinges on the first sieve element 38 to improve the formation of foam. Advantageously, the distance between the constriction and the first sieve element is between 1.8 mm and 2.5 mm, preferably between 2 mm and 2.3 mm.

The sieve carrier device 36 comprises a first tube-shaped part 40 forming a first internal channel part 40*b* of the internal channel 37 and having a first internal channel diameter and an adjoining second tube-shaped part 41 forming a second internal channel part 41*b* of the internal channel having a second internal channel diameter. The first channel diameter is smaller than the second channel diameter such that in a downstream direction towards the dispensing opening 31, the cross-section of the internal channel 37 between the first sieve element 38 and the second sieve element 39 increases. Such increasing diameter of the internal channel 37 between the first sieve element 38 and the second sieve element 38 improves the foam quality of the foam produced by the foam dispensing assembly 1. An end 40*a* of the first tube-shaped part 40 facing away of the second tube-shaped part supports the first sieve element 38 and an end 41*a* of the second tube-shaped part 41 facing away of the first tube-shaped part supports the second sieve element 39.

In the shown embodiment, the increase in diameter of the internal channel 37 is a stepwise increase at the transition of the first channel part to the second channel part. In an alternative embodiment, the increase in cross-section of the internal channel 37 between the first sieve element 38 and the second sieve element 39 may also be a gradual increase over at least a part of the length of the internal channel 37, or a combination thereof.

It is remarked that the transition between the first internal channel part and the second internal channel part of the embodiment of FIG. 1 forms an annular rim that can be used to mount a third sieve element or another element such as a constriction or an acceleration hole.

In FIG. 1, the dispensing assembly 1 is shown in rest position. The spring 60 biases the piston assembly 10 to an upper position, wherein the liquid piston 11 and the air piston 12 are arranged relatively close to the upper end of the liquid cylinder 3 and the air cylinder 4, respectively.

When the common operating part 13 is depressed, the liquid piston 11 and the air piston 12 will be moved downwards therewith decreasing the volume of the liquid pump chamber 14 and the air pump chamber 25, respectively. As a result, liquid in the liquid pump chamber 14 and air in the air pump chamber 25 will be pressurized. The liquid will flow out of the liquid pump chamber 14 via the liquid outlet 16 and the air will flow out of the air pump chamber 25 via the air outlet 27. The air and liquid will commingle in the mixing chamber 29 to form a foam.

The mixture of the air and liquid will flow through the opening 32, where it is accelerated, into the dispensing channel 30 towards the dispensing opening 31. In the dispensing channel 30, the mixture of air and liquid will be pressed through the first and second sieve elements 38, 39 of the sieve carrier device 36 to promote formation and homogenization of foam. The foam will be dispensed at the dispensing opening 31.

The air piston 12 comprises an upper lip and a lower lip which are in sealing engagement with the air cylinder 4. In the upper position of the piston assembly 10, as shown in FIG. 1, the opening 4*a* is sealed by the upper lip and lower lip. However, when the common operating element 13 is depressed the upper lip will pass the opening 4*a* which places the interior of the container in communication with the environmental air. When the pressure in the container has decreased due to liquid being pumped out of the container, the pressure may be leveled to the environmental pressure by introduction of air into the container through the opening 4*a*.

When the common operating part 13 is released, the spring 60 will push the piston assembly 10 back into the upper position shown in FIG. 1. During this return stroke of the piston assembly 10 liquid will be drawn from the interior of the container 100 into the liquid pump chamber 14 and air will be drawn from the environment into the air pump chamber 25 via the air inlet 26.

The foam dispensing assembly is often used as a single use product which is discarded after depletion of the contents of the container on which the dispensing assembly is mounted. In view thereof, it is desirable to provide a foam dispensing assembly having relative low costs. At the same time, the foam quality, for example foam stability of foam produced by the foam dispensing assembly should be substantially the same.

In the embodiment shown in FIG. 1 the effective pump volume of the air pump chamber 14 is about 7 times an effective pump volume of the liquid pump chamber 25, i.e. an air to liquid ratio of about 7:1. Conventional foam dispensing assemblies have an air to liquid ratio of about 10:1.

Since the stroke of the liquid piston 11 and the air piston 12 are substantially the same, a larger air to liquid ratio requires a larger diameter of the air cylinder 4. Thus, by reducing the air to liquid ratio to about 7:1, the maximum diameter of the air cylinder of the air pump can be reduced which results in a reduction of material to be used for the foam-dispensing assembly, and therefor in a reduction of costs.

However, a smaller amount of air generally also results in lower foam quality, in particular a wetter foam. Since some further features of the present invention improve foam quality, the air to liquid ratio of a foam dispensing assembly may be reduced while at the same time an acceptable foam quality is maintained.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

The invention claimed is:

1. A dispensing assembly to dispense a foam, comprising:
a liquid pump having a liquid inlet and a liquid outlet,
an air pump having an air inlet and an air outlet,
a mixing chamber, wherein the air outlet and the liquid outlet are in fluid communication with the mixing chamber,
a dispensing channel, wherein a first end of the dispensing channel is in fluid communication with the mixing chamber and the second end forms a dispensing opening for dispensing foam,
the dispensing channel and the mixing chamber are connected to each other via a constriction,
wherein the constriction is formed by an opening having a cross section which decreases towards the dispensing channel, wherein the constriction comprises a first cylindrical part having a first diameter and a second cylindrical part having a second diameter, wherein the first cylindrical part is closer to the mixing chamber than the second cylindrical part and wherein the first diameter is larger than the second diameter.

2. The dispensing assembly as claimed in claim 1, wherein the opening tapers towards the dispensing channel.

3. The dispensing assembly as claimed in claim 1, wherein a wall forming the opening comprises an annular rim between the mixing chamber and the dispensing channel.

4. The dispensing assembly as claimed in claim 1, wherein the constriction is configured as an accelerator opening for acceleration of a mixture of liquid and air created in the mixing chamber.

5. The dispensing assembly as claimed in claim 1, wherein one or more foam forming devices are arranged in the dispensing channel.

6. The dispensing assembly as claimed in claim 5, wherein the one or more foam forming devices are one or more sieve elements.

7. The dispensing assembly as claimed in claim 1, the cross-section of the constriction is smaller than the cross-section of the mixing chamber and the cross-section of the dispensing channel adjacent to the constriction.

8. The dispensing assembly as claimed in claim 1, wherein the first cylindrical part and the second cylindrical part are connected to each other by a conical part.

9. The dispensing assembly as claimed in claim 1, wherein a height of the mixing chamber is between 2.5 and 3.5 mm.

10. The dispensing assembly as claimed in claim 9, wherein the height of the mixing chamber is between 2.8 mm and 3.3 mm.

11. The dispensing assembly as claimed in claim 1, wherein the mixing chamber has a cylindrical interior having an internal diameter.

12. The dispensing assembly as claimed in claim 11, wherein an internal diameter of the mixing chamber adjacent the constriction is substantially smaller than the internal diameter of the dispensing channel adjacent the constriction.

13. The dispensing assembly as claimed in claim 11, wherein the internal diameter of the mixing chamber is at least 1.5 of a height of the mixing chamber.

14. The dispensing assembly as claimed in claim 1, wherein the dispensing assembly comprises:
a liquid cylinder and an air cylinder, wherein the liquid cylinder has a smaller diameter than the air cylinder, and wherein the liquid cylinder and the air cylinder are arranged substantially concentrically, and
a piston assembly comprising a liquid piston and an air piston for reciprocal movements in the liquid cylinder and air cylinder, respectively, and a common operating part for operating the liquid piston and air piston,
wherein a liquid pump chamber is at least delimited by the liquid cylinder and the liquid piston,
wherein an air pump chamber is at least delimited by the air cylinder, the air piston and the liquid piston.

15. The dispensing assembly as claimed in claim 1, wherein an effective pump volume of the air pump chamber is maximally 8 times an effective pump volume of the liquid pump chamber.

16. The dispensing assembly as claimed in claim 1, wherein the dispensing assembly comprises a sieve carrier device having an internal channel which at least partly forms the dispensing channel, wherein the sieve carrier device supports a first sieve element and a second sieve element, wherein the first sieve element and the second sieve element extend across a cross section of the internal channel in a spaced relationship, and wherein a cross section of the internal channel between the first sieve element and the second sieve element increases in a downstream direction.

17. The dispensing assembly as claimed in claim 16, wherein the sieve carrier device comprises a first tube-shaped part forming a first internal channel part of the internal channel and having a first internal channel diameter and an adjoining second tube-shaped part forming a second internal channel part of the internal channel having a second internal channel diameter,
wherein the first tube-shaped part supports the first sieve element and the second tube-shaped part supports the second sieve element and wherein the first internal channel diameter is smaller than the second internal channel diameter.

18. The dispensing assembly as claimed in claim 17, wherein an end of the first tube-shaped part facing away of the second tube-shaped part supports the first sieve element and wherein an end of the second tube-shaped part facing away of the first tube-shaped part supports the second sieve element.

19. The dispensing assembly as claimed in claim 17, wherein a transition between the first internal channel part and the second internal channel part forms an annular rim, and wherein the sieve carrier device comprises a third sieve element extending across the cross section of the internal channel and wherein the third sieve element is supported by the annular rim.

20. The dispensing assembly as claimed in claim 1, mounted on or in an opening of a container and the container containing a foamable liquid.

* * * * *